US010519638B2

(12) United States Patent
Schuster

(10) Patent No.: US 10,519,638 B2
(45) Date of Patent: Dec. 31, 2019

(54) EXTERNAL HAIR STRAINER

(71) Applicant: Danco, Inc., Irving, TX (US)

(72) Inventor: Michael J. Schuster, Shorewood, IL (US)

(73) Assignee: Danco, Inc., Irving, TX (US)

( * ) Notice: Subject to any disclaimer, the term of this patent is extended or adjusted under 35 U.S.C. 154(b) by 0 days.

(21) Appl. No.: 15/973,282

(22) Filed: May 7, 2018

(65) Prior Publication Data

US 2018/0320349 A1 Nov. 8, 2018

Related U.S. Application Data

(60) Provisional application No. 62/502,975, filed on May 8, 2017.

(51) Int. Cl.
*E03C 1/262* (2006.01)
*E03C 1/264* (2006.01)

(52) U.S. Cl.
CPC ..... *E03C 1/262* (2013.01); *E03C 1/264* (2013.01)

(58) Field of Classification Search
CPC ..... E03C 1/262
USPC ..... 4/292; D23/260–261
See application file for complete search history.

(56) References Cited

U.S. PATENT DOCUMENTS

| | | | | |
|---|---|---|---|---|
| 7,500,282 | B1 * | 3/2009 | Park | A47K 7/02 15/160 |
| 2009/0049594 | A1 * | 2/2009 | Landsberger | E03C 1/264 4/292 |
| 2010/0213140 | A1 * | 8/2010 | Won | E03C 1/264 210/767 |

* cited by examiner

*Primary Examiner* — Christine J Skubinna
(74) *Attorney, Agent, or Firm* — Thomas Horstemeyer, LLP

(57) ABSTRACT

Disclosed are various embodiments for an external hair catcher. The external hair catcher can include a rim positioned on a first plane. In some instances, the external hair catcher can include a button positioned on a second plane parallel to the first plane. In other instances, the external hair catcher can include a suction cup protruding from the button in the direction of the rim. Moreover, the external hair catcher can include a plurality of spokes connecting an inner diameter of the rim to an outer diameter of the button, each of the plurality of spokes comprising a bend.

20 Claims, 3 Drawing Sheets

EXTERNAL HAIR STRAINER

CROSS-REFERENCE TO RELATED APPLICATIONS

This application claims priority to, and the benefit of, U.S. Provisional Patent Application No. 62/502,975, entitled "EXTERNAL HAIR STRAINER" and filed on May 8, 2017, which is incorporated by reference as if set forth herein in its entirety.

BACKGROUND

Hair can accumulate in drains, such as bathtub, shower, and sink drains. As hair accumulates, the flow of water through the drain decreases until the drain clogs and water can no longer flow through the drain. The accumulated hair must be physically removed by either disassembling the drain, running a rotary pipe-snake through the drain to clear the clog, or adding harsh chemicals into the drain in an attempt to dissolve the hair. Each of these processes risks damaging the drain itself or injuring the individual attempting to clear the drain.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

DETAILED DESCRIPTION

Figure 1A:
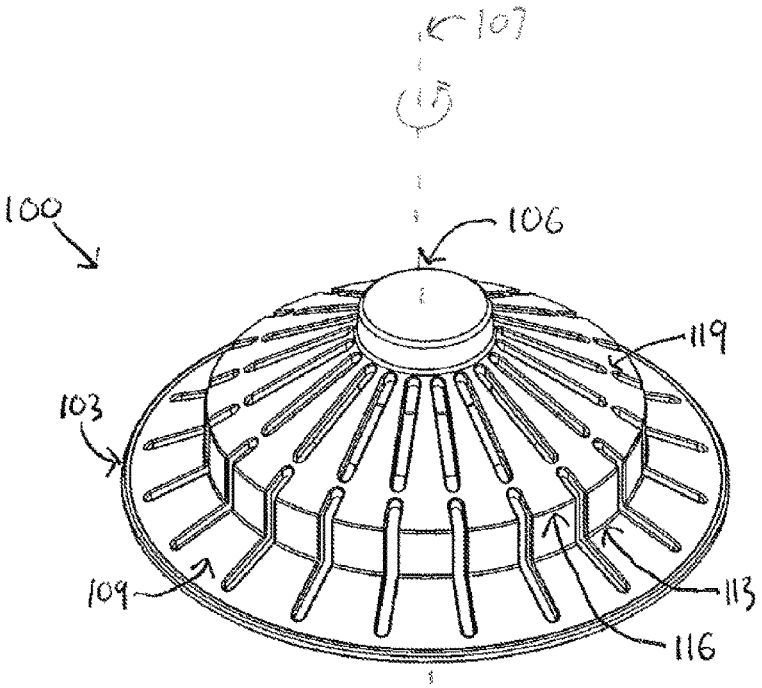
FIG. 1A and FIG. 1B are perspective views of an external hair strainer in accordance with various embodiments of the present disclosure.

FIG. 1A shows a perspective view of an external hair strainer 100. The external hair strainer 100 can be affixed to a drain stopper (e.g., a bathtub or kitchen drain stopper) in order to prevent hair from entering and accumulating in a drain. The external hair strainer 100 may be manufactured from any number of flexible materials, including various silicone compounds, rubber or synthetic rubber compounds, or other appropriate materials.

The external hair strainer 100 can include a rim 103 at the base of the external hair strainer 100, a button 106 at the top of the external hair strainer 100, a plurality of spokes 109 connecting the rim 103 to the button 106, a first bend 113, and a second bend 116. The rim 103 is positioned to form at least a partial seal with a surface, such as a bathtub surface or sink surface. The button 106 can be depressed to engage the external hair strainer 100 with a drain stopper, such as a stopper for a bath tub or sink. The rim 103 is located on a first plane, while the button 106 is located on a second plane parallel to the first plane. The rim 103 and the button 106 are both centered along the same axis of rotation 107 that runs perpendicular to the first plane and the second plane.

Figure 1B:
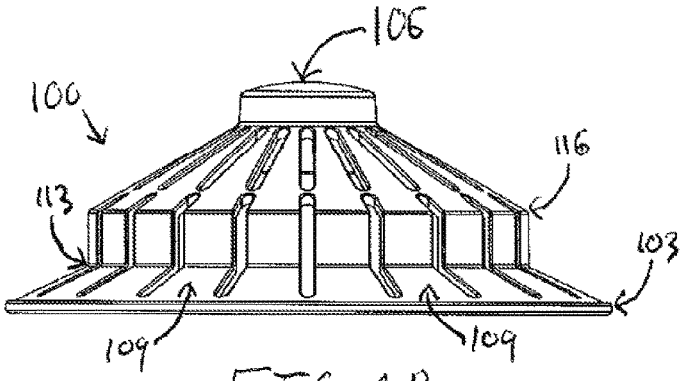

FIG. 1B shows another perspective view of the external hair strainer 100. As shown, a rim 103 at the base of the external hair strainer 100 is connected to the button 106 at the top of the external hair strainer 100 by a plurality of spokes 109. Each of the plurality of spokes 109 are tapered as they connect the inner diameter of the rim 103 of the external hair strainer 100 with the outer diameter of the button 106, thereby forming a collapsible skirt extending from the button 106 to the rim 103. The inner diameter of the rim 103 is greater than the outer diameter of the button 106 and each of the plurality of spokes 109 is narrower at a first connection with the button 106 and wider at a second connection with the rim 103. In some embodiments, the spokes 109 may be set at equidistant points along the rim 103 with respect to adjacent spokes 109. Each spoke 109 in the plurality of spokes 109 may be separated from other spokes 109 by gaps that allow water or other liquids to pass through the external hair strainer 100 while preventing hair or other objects from entering a drain.

A first bend 113 and second bend 116 on each spoke 109 prevent the external hair catcher 100 from returning to its original shape when the plurality of spokes 109 are flexed as a result of the button 106 being depressed. The first bend 113 and the second bend 113 may be placed one above the other at a point approximately half-way between the inner diameter of the rim 103 and the outer diameter of the button 106. For instance, the first bend 113 and the second bend 116 may be located on separate horizontal plans crossing through the spoke 109 and also located along the same line running perpendicularly through the separate horizontal planes. This arrangement increases the hoop strength of the external hair catcher 100 to prevent the external hair catcher 100 from inverting when the spokes 109 are flexed. Moreover, the first bend 113 of each spoke 109 may be located at the same position on each spoke 109, forming a first concentric circle between the rim 103 and the button 106. Likewise, the second bend 116 of each spoke 109 may be located at the same position on each spoke 109, forming a second concentric circle between the rim 103 and the button 106.

Any two spokes 109 may also be connected with a connector 119. The connector 119 helps to maintain the form of the external hair strainer 100 as it flexes between positions as may occur, for example, when the button 106 is depressed or raised. Although the connector 119 depicted in FIG. 1A is position between the second bend 116 and the button 106, the connector 119 may be placed in other locations as may be appropriate for particular embodiments of the present disclosure. For example, the connector 119 could be placed between the first bend 113 and the second bend 116.

Figure 1C:
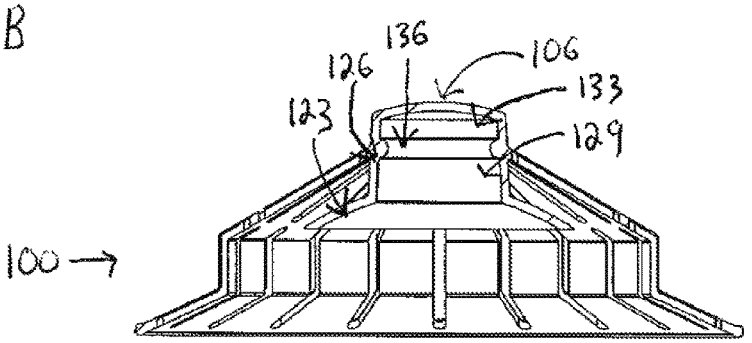
FIG. 1C is a cross sectional view of the perspective view of FIG. 1B, illustrating a suction cup of the external hair strainer in accordance with various embodiments of the present disclosure.

FIG. 1C depicts a cross sectional view of the perspective view of FIG. 1B, illustrating a suction cup 123 of the external hair strainer 100. As shown, the suction cup 123 extends from a bottom surface of the button 106, placing the suction cup 123 within the collapsible skirt formed by the plurality of spokes 109. Moreover, the bottom of the suction cup 123, as illustrated, lies within a third plane positioned between, and parallel to, the first plane containing the rim 103 and the second plane containing the button 106. The suction cup 123 also includes an internal cavity 126 separated into a first chamber 129 and a second chamber 133 by a ridge 136. The internal cavity 126 allows for the suction cup 123 to generate suction when pressed against a surface.

The first chamber 129 and the second chamber 133 allow for a knob or similar portion of a drain stopper to fit within the internal cavity 126 of the suction cup 123. The ridge 136 allows for the suction cup to grab know of the drain stopper, thereby attaching the suction cup 123 and the external hair strainer 100 to the knob of the drain stopper.

Figure 2:
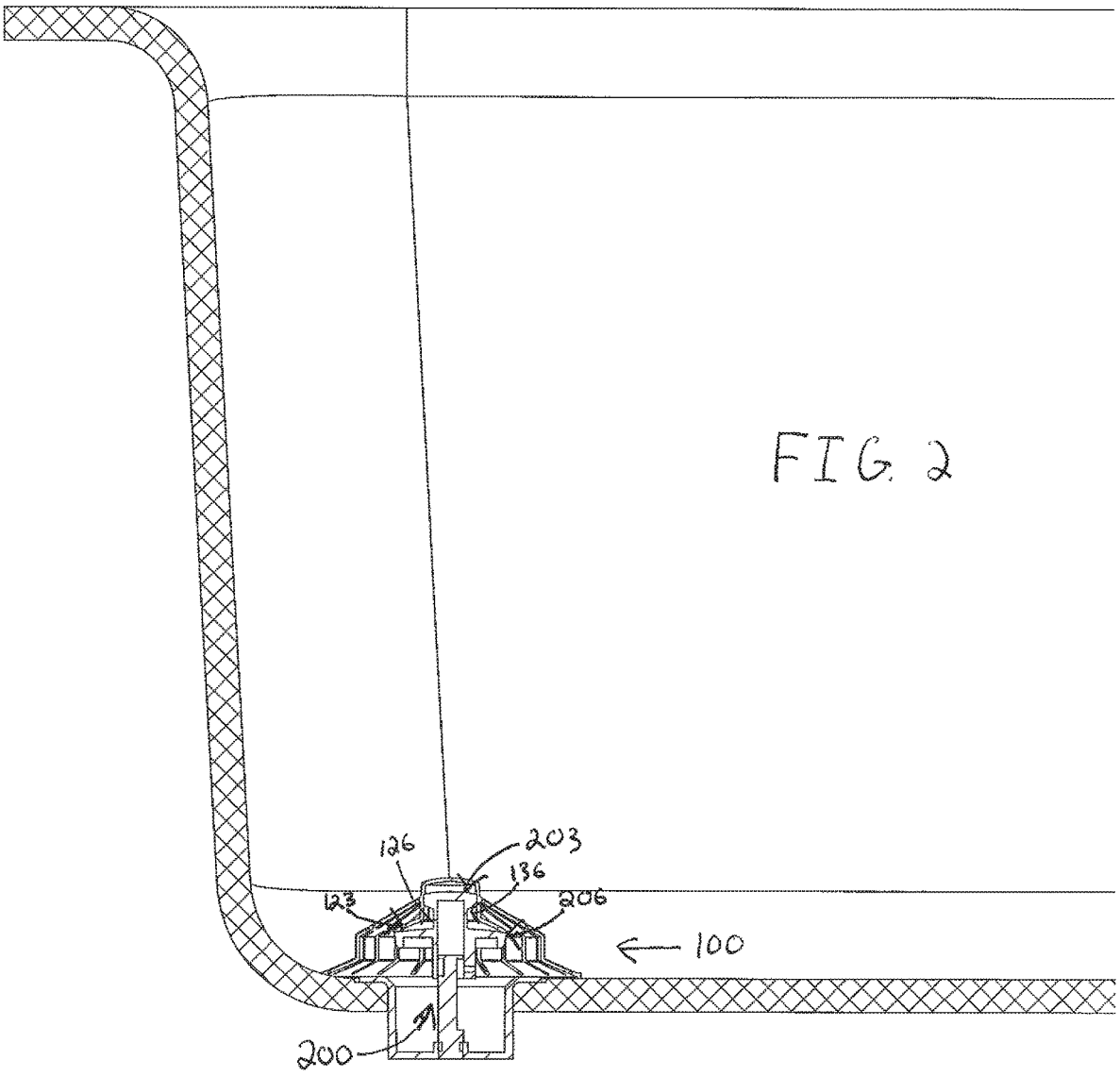
FIG. 2 is a cross sectional view illustrating the external hair strainer positioned on top of a drain stopper of a bathtub in accordance with various embodiments of the present disclosure.

FIG. 2 represents a cross-sectional view illustrating the external hair strainer 100 positioned on top of a drain stopper 200 of a bathtub in accordance with various embodiments of the present disclosure. As shown, the drain stopper 200 extends into the internal cavity 126 of the suction cup 123. The knob 203 of the drain stopper 200 sits above the ridge 136 within the second chamber 133 of the internal cavity 126 of the suction cup 123. Likewise, the suction cup 123 forms at least a partial seal with the top surface 206 of the drain stopper 200, thereby attaching the external hair strainer 100 to the drain stopper 200. The spokes 109 can flex at the first bend 113 or the second bend 116 to allow the collapsible skirt formed by the plurality of spokes 109 to partially collapse, such that the rim 103 can remain substantially within the first plane and maintain contact with a surface surrounding the drain stopper 200 (e.g., a sink surface) as the button 106 is depressed.

Figure 3:
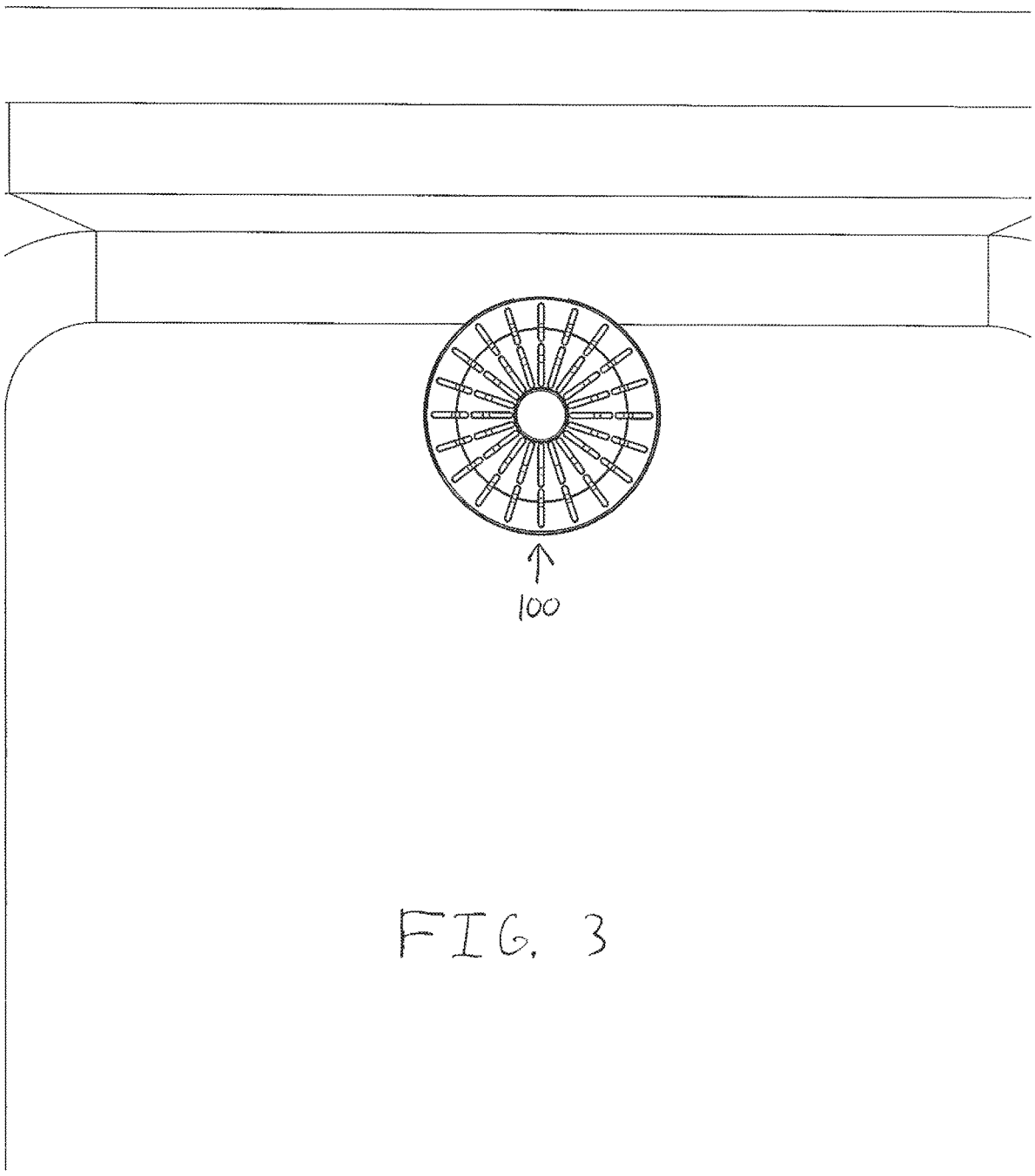
FIG. 3 is a perspective view illustrating the external hair strainer positioned on top of a drain stopper of a bathtub in accordance with various embodiments of the present disclosure.

FIG. 3 is a top-down perspective view illustrating the external hair strainer positioned on top of a drain stopper of a bathtub in accordance with various embodiments of the present disclosure.

While tub drains were described it should be noted that this hair catcher is not limited to tub drains as the same design can also be used in bathroom lavatory drains as well as kitchen sink drains or any other drain as appropriate.

The following is claimed:

1. An apparatus, comprising:

a rim positioned on a first plane;

a button positioned on a second plane parallel to the first plane;

a suction cup protruding from the button in the direction of the rim, the suction cup comprising an internal cavity separated into a first chamber and a second chamber by a ridge, wherein the suction cup is configured to secure a knob of a drain stop in the second chamber which is above the ridge;

a plurality of spokes connecting an inner diameter of the rim to an outer diameter of the button, each of the plurality of spokes comprising a bend; and a plurality of connectors, each of the plurality of connectors connecting adjacent ones of the plurality of spokes.

2. The apparatus of claim 1, wherein the plurality of spokes connect to the inner diameter of the rim at equidistant points.

3. The apparatus of claim 1, wherein the plurality of spokes connect to the outer diameter of the button at equidistant points.

4. The apparatus of claim 1, wherein the bend in each of the plurality of spokes is located at the same position on each of the respective ones of the plurality of spokes to form a concentric circle between the rim and the button.

5. The apparatus of claim 1, wherein the rim, the button, and the plurality of spokes are manufactured from a flexible material.

6. The apparatus of claim 1, wherein the rim and the button are centered on an axis of rotation perpendicular to the first plane and the second plane.

7. The apparatus of claim 1, wherein each of the plurality of spokes are tapered, wherein each of the plurality of spokes are narrower at a first connection with the button and wider at a second connection with the rim.

8. A device, comprising:

a rim positioned on a first plane;

a button positioned on a second plane parallel to the first plane;

a suction cup protruding from the button in the direction of the rim; and a collapsible skirt formed by a plurality of spokes connecting an inner diameter of the rim to an outer diameter of the button, each of the plurality of spokes comprising:

a first bend located at the same first position on each of the respective ones of the plurality of spokes to form a first concentric circle between the rim and the button;

a second bend located at the same second position on each of the respective ones of the plurality of spokes to form a second concentric circle between the rim and the button; and wherein the first bend and the second bend of each one of the plurality of spokes are located on separate parallel horizontal planes crossing through the spoke and along a line running perpendicularly through the separate parallel horizontal planes, the line being located at a point approximately half-way between the inner diameter of the rim and the outer diameter of the button.

9. The device of claim 8, further comprising a plurality of connectors, each of the plurality of connectors connecting adjacent ones of the plurality of spokes.

10. The device of claim 8, wherein a bottom of the suction cup lies within a third plane positioned between the first plane and the second plane and parallel to the first plane and the second plane.

11. The device of claim 8, wherein the suction cup comprises an internal cavity separated into a first chamber and a second chamber by a ridge.

12. The device of claim 8, wherein the plurality of spokes connect to the outer diameter of the rim at equidistant points.

13. The device of claim 8, wherein the plurality of spokes connect to the inner diameter of the button at equidistant points.

14. The device of claim 13, wherein the suction cup is centered on the axis of rotation perpendicular to the first plane and the second plane.

15. The device of claim 8, wherein each of the plurality of spokes are tapered and each of the plurality of spokes are narrower at a first connection with the button and wider at a second connection with the rim.

16. The device of claim 8, wherein the rim, the button, and the plurality of spokes are manufactured from a flexible material.

17. An apparatus, comprising:

a rim positioned on a first plane;

a button positioned on a second plane parallel to the first plane;

a suction cup protruding from the button in the direction of the rim, the suction cup comprising an internal cavity separated into a first chamber and a second chamber by a ridge; and a collapsible skirt formed by a plurality of spokes connecting an inner diameter of the rim to an outer diameter of the button, each of the plurality of spokes comprising:

a first bend located at the same first position on each of the respective ones of the plurality of spokes to form a first concentric circle between the rim and the button;

a second bend located at the same second position on each of the respective ones of the plurality of spokes to form a second concentric circle between the rim and the button; and wherein the first bend and the second bend of each one of the plurality of spokes are located on separate parallel horizontal planes crossing through the spoke and along a line running perpendicularly through the separate parallel horizontal planes, the line being located at a point approximately half-way between the inner diameter of the rim and the outer diameter of the button; and a plurality of connectors, each of the plurality of connectors connecting adjacent ones of the plurality of spokes.

18. The apparatus of claim 17, wherein the rim, the button, and the suction cup are centered on an axis of rotation perpendicular to the first plane and the second plane.

19. The apparatus of claim 17, wherein the plurality of spokes connect to the inner diameter of the button at equidistant points and connect to the outer diameter of the rim at equidistant points.

20. The apparatus of claim 17, wherein each of the plurality of spokes are tapered and each of the plurality of spokes are narrower at a first connection with the button and wider at a second connection with the rim.

* * * * *